US005152039A

United States Patent [19]

Spurny

[11] Patent Number: 5,152,039

[45] Date of Patent: Oct. 6, 1992

[54] DEVICE FOR ALIGNING WEFTS OF MOVING TEXTILE WEB

[75] Inventor: Josef Spurny, Liberec, Czechoslovakia

[73] Assignee: Elitex Liberec, Czechoslovakia

[21] Appl. No.: 579,314

[22] Filed: Sep. 7, 1990

[30] Foreign Application Priority Data

Sep. 7, 1989 [CS] Czechoslovakia ..... 5151-89

[51] Int. Cl.[5] ..... D06C 3/00; D06H 3/12

[52] U.S. Cl. ..... 26/51.3; 26/51

[58] Field of Search ..... 26/51, 51.3, 51.4, 99–105, 26/51.5

[56] References Cited

U.S. PATENT DOCUMENTS

| | | | |
|---|---|---|---|
| 920,122 | 5/1909 | Farnworth | 26/51.3 |
| 1,222,776 | 4/1917 | Lowe et al. | 26/51.3 |
| 1,814,652 | 7/1931 | Weiss | 26/103 |
| 1,853,975 | 4/1932 | Isherwood | 26/101 |
| 2,713,191 | 7/1955 | Broomfield | 26/51.3 |
| 2,854,131 | 9/1958 | Murray | 26/51.3 X |
| 3,652,389 | 3/1972 | Helland | 26/51.3 X |
| 3,666,156 | 5/1972 | Becker | 26/51.3 |

FOREIGN PATENT DOCUMENTS

| | | | |
|---|---|---|---|
| 835923 | 10/1938 | France | 26/51.3 |
| 138301 | 2/1930 | Switzerland | 26/103 |
| 290976 | 3/1969 | U.S.S.R. | 26/51.3 |
| 416949 | 9/1934 | United Kingdom | 26/51.3 |

OTHER PUBLICATIONS

Mount Hope Data—Mount Hope Machinery Company, Taunton, Mass. ©1973.

*Primary Examiner*—Werner H. Schroeder
*Assistant Examiner*—John J. Calvert
*Attorney, Agent, or Firm*—Ostrolenk, Faber, Gerb & Soffen

[57] ABSTRACT

A device for aligning wefts of textile belts comprises four arched cylinders which are positioned so that they define a regular or irregular quadrilateral. The orientations of the axes and angular positions of the cylinders are adjustable. In other words, the cylinders are tiltably and rotatably mounted. The cylinder positions are adjusted so as to ensure that the textile belt to be aligned is able to contact only that part of the circumferential surface of the cylinders which has a predominantly widening effect on the textile belt. The mechanism of orienting the four arched cylinders includes two servomotors for driving gears and transmission chains in a manner which is effective for selectively tilting and/or rotating the cylinders so as to correct textile belts having arch-like and/or skewed wefts.

12 Claims, 8 Drawing Sheets

DEVICE FOR ALIGNING WEFTS OF MOVING TEXTILE WEB

BACKGROUND OF THE INVENTION

The present invention relates to a device for aligning wefts of textile web, in particular to a device for spacially positioning and repositioning wefts to align the same. These wefts are associated with textile sheets or webs, or rows in textile knitwear webs. Such wefts need to be aligned relative to the longitudinal axis of the webs.

The system most often used for aligning wefts of a moving textile web comprises two or more straight, diagonally adjustable cylinders and two or more rotatably adjustable arched cylinders. By entraining the moving textile web on the diagonally adjustable, straight cylinders and on the suitably adjusted arched cylinders, different wefts situated at different locations along the width of the web travel paths of different lengths. Since, however, all the wefts across the width of the moving textile web must have the same forward speed, sections of weft which initially traverse longer paths are forced to adjust their position, aligning the wefts.

In another known device, path length differences are obtained by means of only two arched cylinders that are adjustable both diagonally and rotatably. The cylinder positions are adjusted by servomotors actuated by signals received from photoelectrical or electromechanical sensors monitoring the weft thread position in the moving textile web.

The drawback of the above described devices is that, longitudinal folds are formed in the textile web when weft path length differences are created by diagonal adjustment of the straight aligning cylinders. In some textile materials, these longitudinal folds produce lasting irreparable faults. The longitudinal folds are especially likely to occur when the textile web is led across the arched cylinders when the cylinders are set to a position designed to align wefts which have a so-called rearward arch. This occurs because rotation of the arched cylinder around its arched axle produces, in a step by step manner, lengthening of circular arches passing on the surface of the arched cylinder parallel to the arched axle of the cylinder on one half of the cylinder circumference, and shortening of these circular arches on the other half of the cylinder circumference.

Thus, the textile belt in contact with one half of the arched cylinder tends to widen. The other half of the belt develops the longitudinal folds. The dimensions of the folds depend on the elasticity of the textile belt being aligned and on the extent of the weft deformations which need to be corrected. To avoid or reduce forming these longitudinal folds, the degree to which the cylinders can be adjusted, i.e. the aligning capacity, must be limited. As a result, the textile web must be passed through the machine several times to obtain perfect aligning of the wefts which is both technologically and economically disadvantageous.

SUMMARY OF THE INVENTION

The device according to the present invention eliminates the drawbacks of the known devices by using four aligning arched cylinders for weft alignment. The underlying principle of the invention consists essentially in that the aligning arched cylinders are situated so that they define a regular or irregular quadrilateral. The moving textile web contacts only that part of the surface of the aligning arched cylinders that has a predominantly widening effect thereon.

To permit both diagonal, i.e. axial, tilting and angular positioning of the arched cylinders in as simple a manner as possible, it is advantageous to join the arched cylinders with cross-pin cardan joints to sliding gear boxes fitted with motion nuts through which pass motion screws. In other words, the ends of the arched cylinders axles are fixedly joined in the sense of their common rotatability and ability to slide in the axial direction. The sliding gear boxes are slidably mounted on guiding shafts, transmitting torque to worm gears inside the sliding gear boxes.

After exact and simultaneous adjusting of the sliding gear boxes is obtained, the motion screws are connected with each other by worm gears and by transmission chains. Simultaneously, these gears and chains, located on the left side of the arched cylinders, are connected with those on the right side of the aligning cylinders by means of a through shaft. The diagonal adjustment of the position of the arched cylinders is obtained by setting the rotational direction sense of the motion screws and motion nuts. The whole system is actuated by a servomotor which dispenses with the problem of weft skewing.

To obtain exact and simultaneous adjustment of the angular, i.e. rotational, relative positions of the arched axles of the arched cylinders, it is advantageous to ensure that the guiding shafts, provided for producing rotational forces in the sliding gear boxes, are interconnected with each other, for instance by means of worm gears and transmission chains, and that at the same time, the gears and transmission chains on the left side of the arched cylinders be interconnected, by means of a through shaft, with corresponding gears and transmission chains on the right side of the arched cylinders. A system of guiding shafts of the invention is actuated by another servomotor provides to align a belt having an arch-shaped weft.

An advantage of the device according to the present invention consists in that aligning of wefts deformed by skewing takes place while the textile web is being widened.

Other advantages of the present invention consist in that it is no longer necessary to limit the aligning capacity of the device as when large weft deformations are encountered. This dispenses with the need to pass the textile web through the machine several times. Still another advantage consists in that the textile web arrives at the photoelectrical or electromechanical sensors in a fully open state, thus increasing the functional precision of the sensors.

Other features and advantages of the present invention will become apparent from the following description of the invention which refers to the accompanying drawings.

DETAILED DESCRIPTION OF THE DRAWINGS

Figure 1:
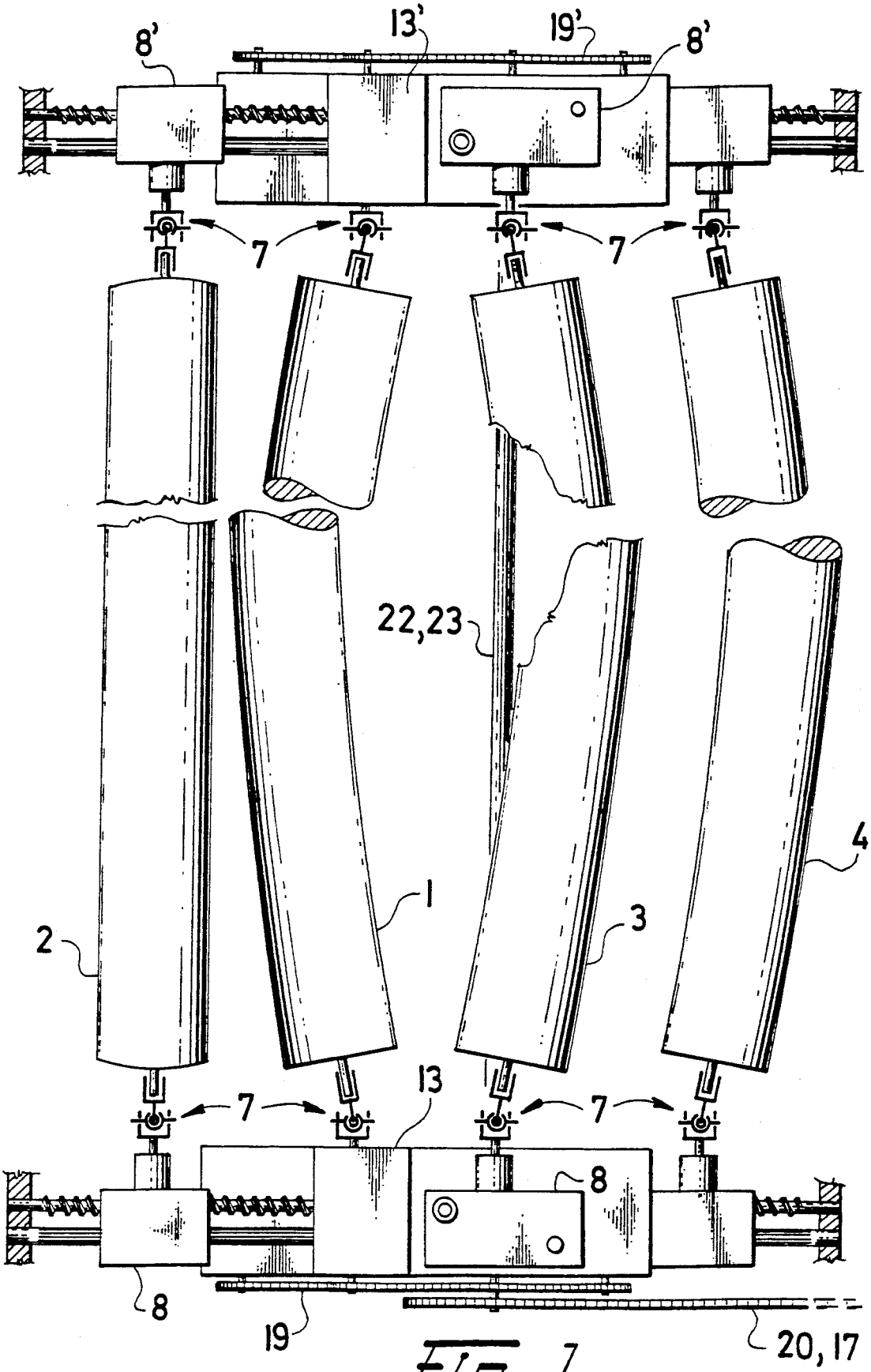
FIG. 1 is a schematical front view showing a system of arched cylinders in their basic position in which they exert no aligning effect. Also illustrated is a connection scheme for the arched axles of these cylinders with gear boxes which permit displacement (adjustment) of the locations of the ends of the axles.

In FIGS. 3, 4, 5, 7 and 8, the circle sectors define, on the one hand, parts of the circumference of the arched cylinders that in view of their sense of rotation have a widening effect on the textile web and, on the other hand, other parts of the circumference that have the contrary, i.e., negative widening effect, on the textile web.

The device comprises four, conventionally constructed arched cylinders 1, 2, 3, 4 that are, due to their fixed arched axles, adapted to be diagonally (tiltably) and angularly (rotatably) adjusted by servomotors 18 and 21. Two straight guiding cylinders 5 and 6 ensure that a constant position is imparted to the textile web before the web reaches arched cylinder 1 and after it leaves the last arched cylinder 4. In the illustrated embodiment, the arched cylinders 1, 2, 3, 4, and more specifically, the distal ends of their arched axles, are connected with cross-pin cardan joints 7, whereby they move angularly together and are also slidably movable.

The cross-pin cardan joints 7 are rotatably seated in sliding (traversable) gear boxes 8 and 8' and are fixed to the worm wheels of worm gears 9. Also provided in the gear boxes 8 and 8' are motion nuts 10 through which motion screws 11 pass. By means of the worms of the worm gears 9, the gear boxes 8 and 8' are traversably mounted on guiding shafts 12.

The motion screws 11 and the guiding shafts 12 are rotatably mounted in two central gear boxes 13 and 13', wherein each of the boxes 13, 13' contains two worm gears 14 for driving the motion screws 11 and four worm gears 15 for driving the guide shafts 12. Each pair of the worm gears 14 are interconnected by transmission chain 16 and driven, via transmission chain 17, by the servomotor 18. The worm gears 15 are interconnected by transmission chain 19 and driven, via transmission chain 20, by the servomotor 21.

Figure 3:
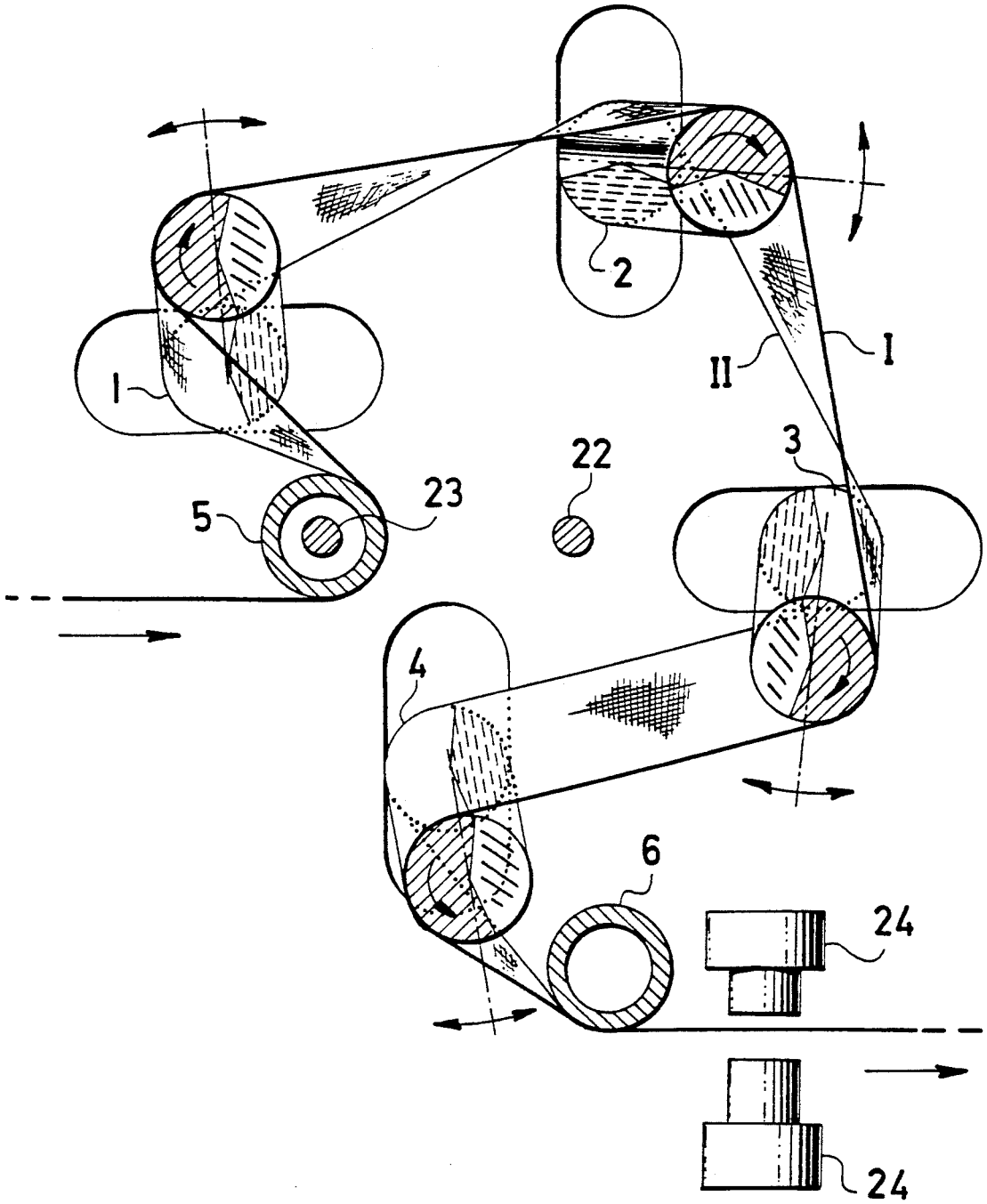
FIG. 3 is a cross section through the center of the system of arched cylinders in their basic position in which they exert no aligning effect.
Figure 4:
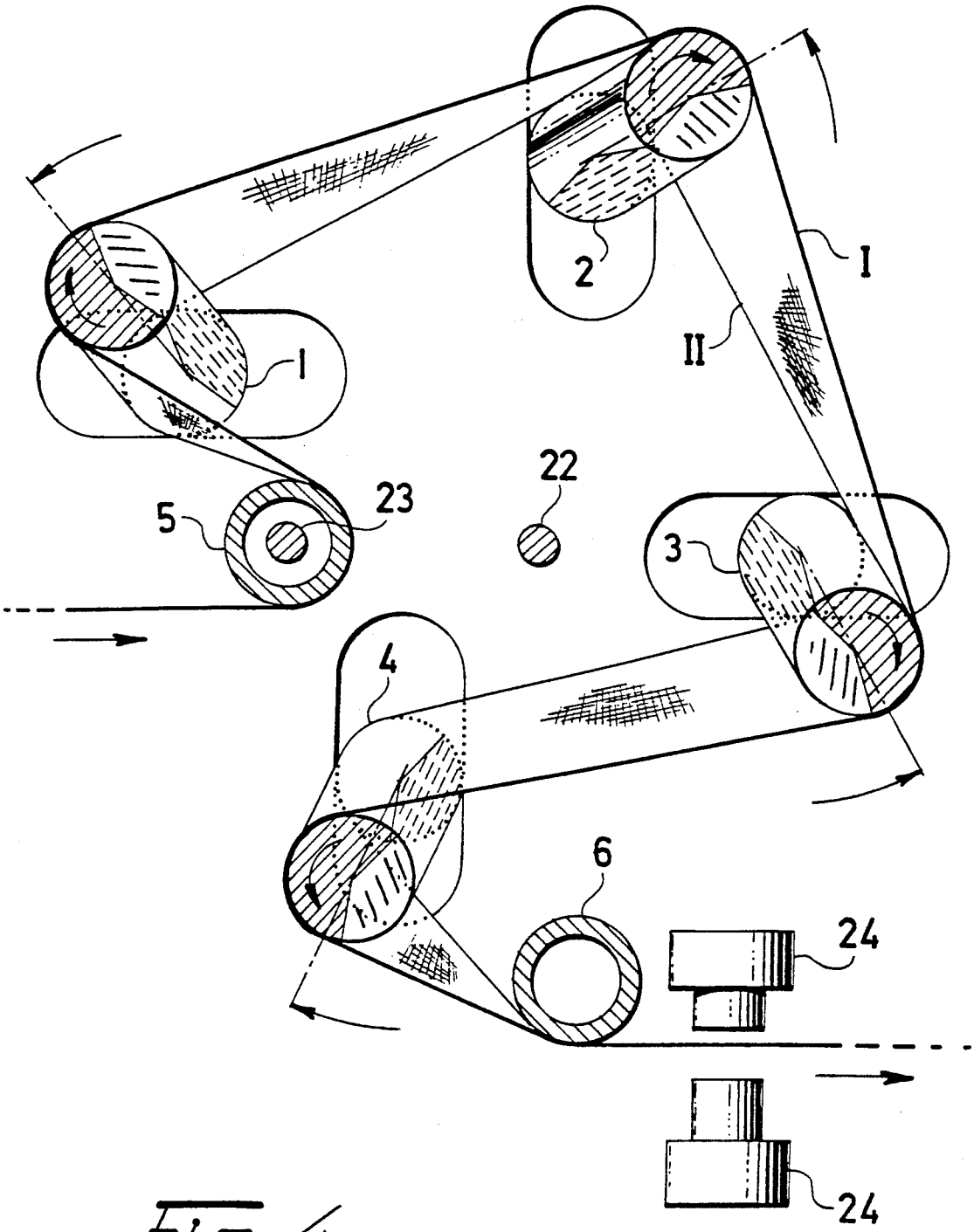
FIG. 4 is a cross section through the center of the system of arched cylinders, angularly positioned so as to optimize alignment of a forward arch without effect on weft skewing.

The worm of one of the worm gears 14 in the central gear box 13 is connected by means of a through shaft 22 (FIG. 3) with one of the worms of a corresponding worm gears 14 located in the central gear box 13'. Similarly, the worm of one of the worm gears 15 in the central gear box 13 is connected by means of a through shaft 23 with the worm of a corresponding worm gear in the central box 13'. In a preferred construction, the shaft 23 also serves as the axle of the straight guiding cylinder 5 (FIG. 3).

The required identity in the sense of rotation of the pairs of the cross-pin cardan joints 7 assigned to the arched cylinders 1, 2, 3, and the opposite sense of rotation of the arched cylinder 4, are achieved by appropriately selecting the thread rotation direction of each of the worm gears 15 or 9.

A required difference in the direction of displacement of the gear boxes 8 with respect to the gear boxes 8', necessary for diagonally tilting the arched cylinders 1, 2, 3, 4, is obtained by appropriately choosing the thread turning direction of the worm gears 14 in combination with the turning direction of the motion screws 11 and of the motion nuts 10.

The servomotors 18 and 21 are controlled in known manner from a control box (not illustrated), with signals received from the weft position sensors 24 situated downstream (relative to the textile belt feed direction) of the arched cylinders 1, 2, 3, 4, and the guiding cylinder 6.

The diagonal (axial) orientation of the arched cylinders 1, 2, 3, 4 is adjusted by means of the servomotor 18 whose rotational motion is transmitted, via transmission chain 17, to the mutually interconnected (by the transmission chain 16) worm gears 14 located in the central gear box 13 and is also transmitted by means of the through shaft 22 to the worm gears 14 in the central gear box 13'.

Figure 2:
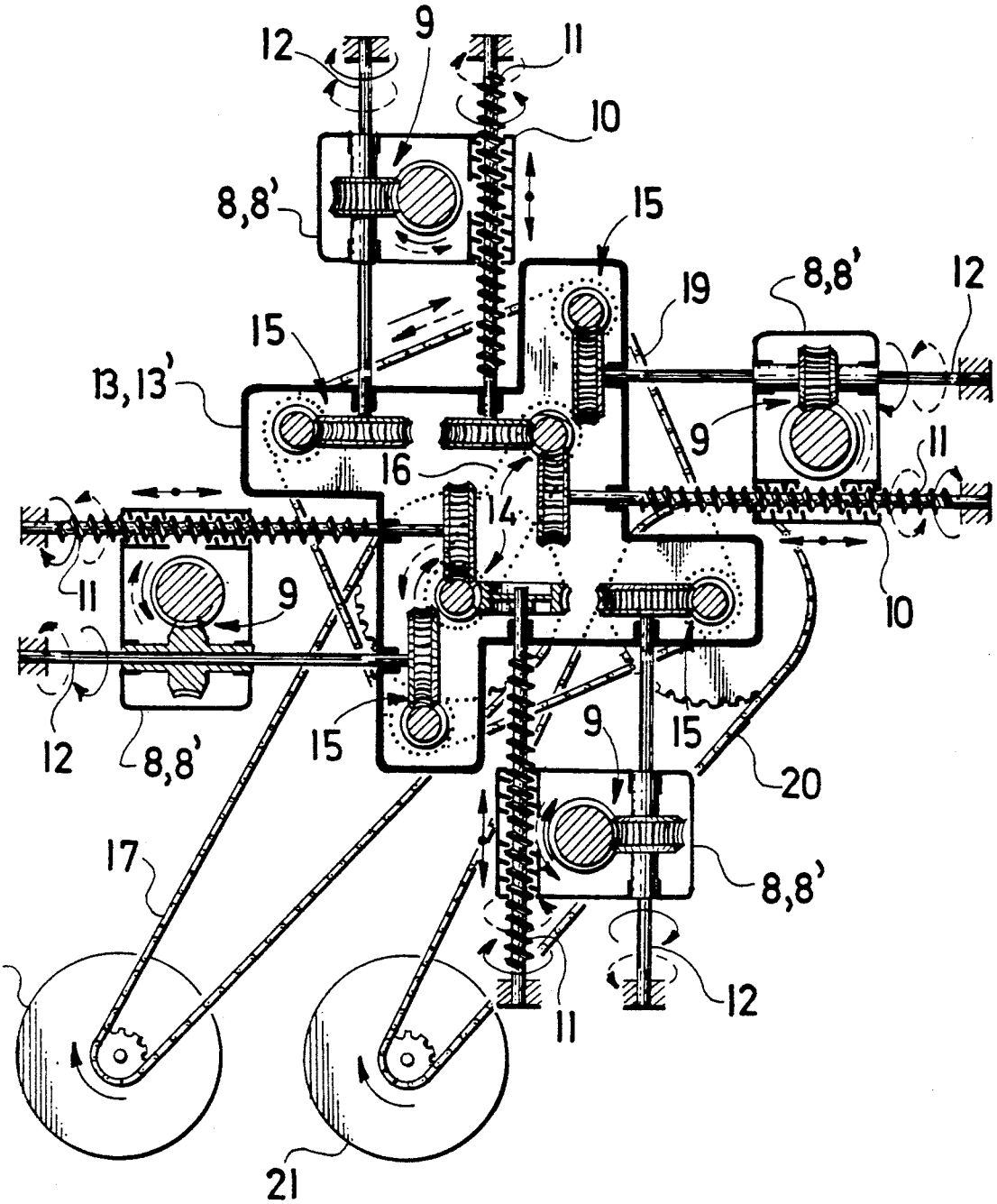
FIG. 2 is a schematical side view of the gear boxes on the left side of the arched cylinders.

The worm gears 14 drive the motion screws 11 whose rotation displaces the gear boxes 8 (on the right side of FIG. 2) toward one side, for instance to the left side, (towards the center) and at the same time the gear boxes 8' in the opposite direction. The connection of the gear boxes 8 and 8' to opposite axial ends of the cylinders (by means of the cross-pin cardan joints 7) causes the arched cylinders 1, 2, 3, 4 to tilt diagonally in one direction. To tilt the cylinders in the opposite direction, the sense of rotation of the servomotor 18 is reversed.

The angular (rotational) position of the arched cylinders 1, 2, 3, 4 is adjusted with the servomotor 21 whose rotational motion is transmitted, via transmission chain 20, to the worm gears 15. The worm gears 15 are interconnected by the transmission chain 19. The rotation of the servomotor 21 is also transmitted, by means of the through shaft 23, to the worm gears 15 located in the central gear box 13'. The worm gears 13 are interconnected by a transmission chain 19'.

The worm gears 15 are so designed that they turn the cross-pin cardan joints 7 and, therefore, the arched cylinders 1, 2, 3 in one direction, via guiding shafts 12 and worm gears 9. Simultaneously, the cross-pin cardan joint 7 associated with the arched cylinder 4 turns in the opposite direction. To change the turning direction of the aligning arched cylinders 1, 2, 3, 4, the sense of rotation of the servomotor 21 is reversed.

When a textile web with an aligned, non-deformed weft is fed through the machine, the weft position sensors 24 and the non-illustrated control box operate the servomotors 18 and 21 so that the arched cylinders 1, 2, 3, 4 are set to the position shown in FIGS. 1 and 3. In this position, the textile web path length measured between the guiding cylinders 5 and 6 at a central section I of the textile web is equal to the path length at the edge (lateral) sections II. Because of the equal length of these longitudinal sections at this orientation of the arched cylinders 1, 2, 3, 4, no weft deformation is produced.

Figure 5:
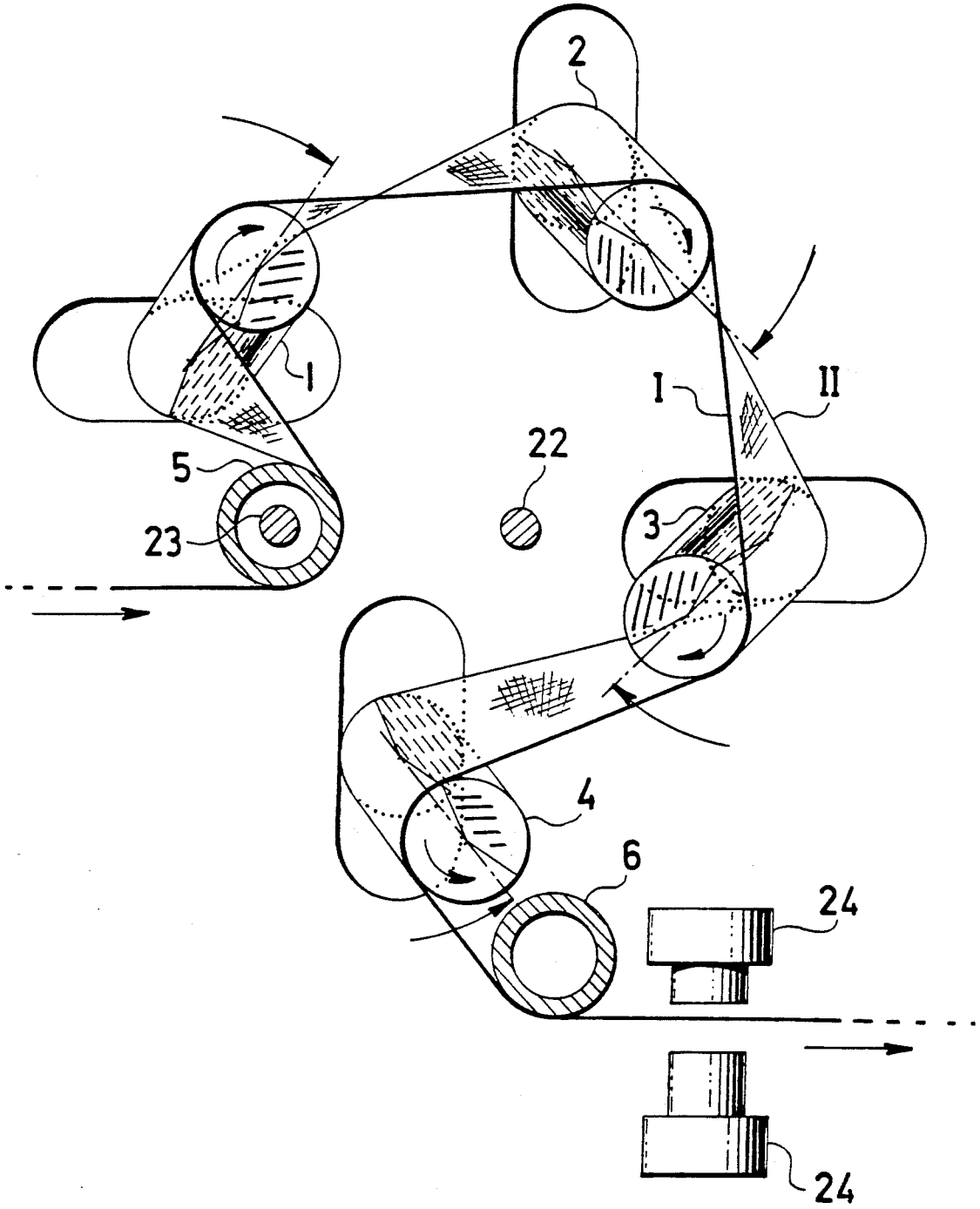
FIG. 5 is a cross section through the center of the system of arched cylinders, angularly positioned so as to optimize alignment of a rearward arch without effect on weft skewing.

When it is necessary to handle a textile web with a forward arch, the arched cylinders assume the position shown in FIG. 5. In this cylinder orientation, the path length of the central section I of the textile web is shorter than that at the lateral sections II. Thus, the central section I of the textile web is pushed forwards, and the weft is aligned.

Figure 6:
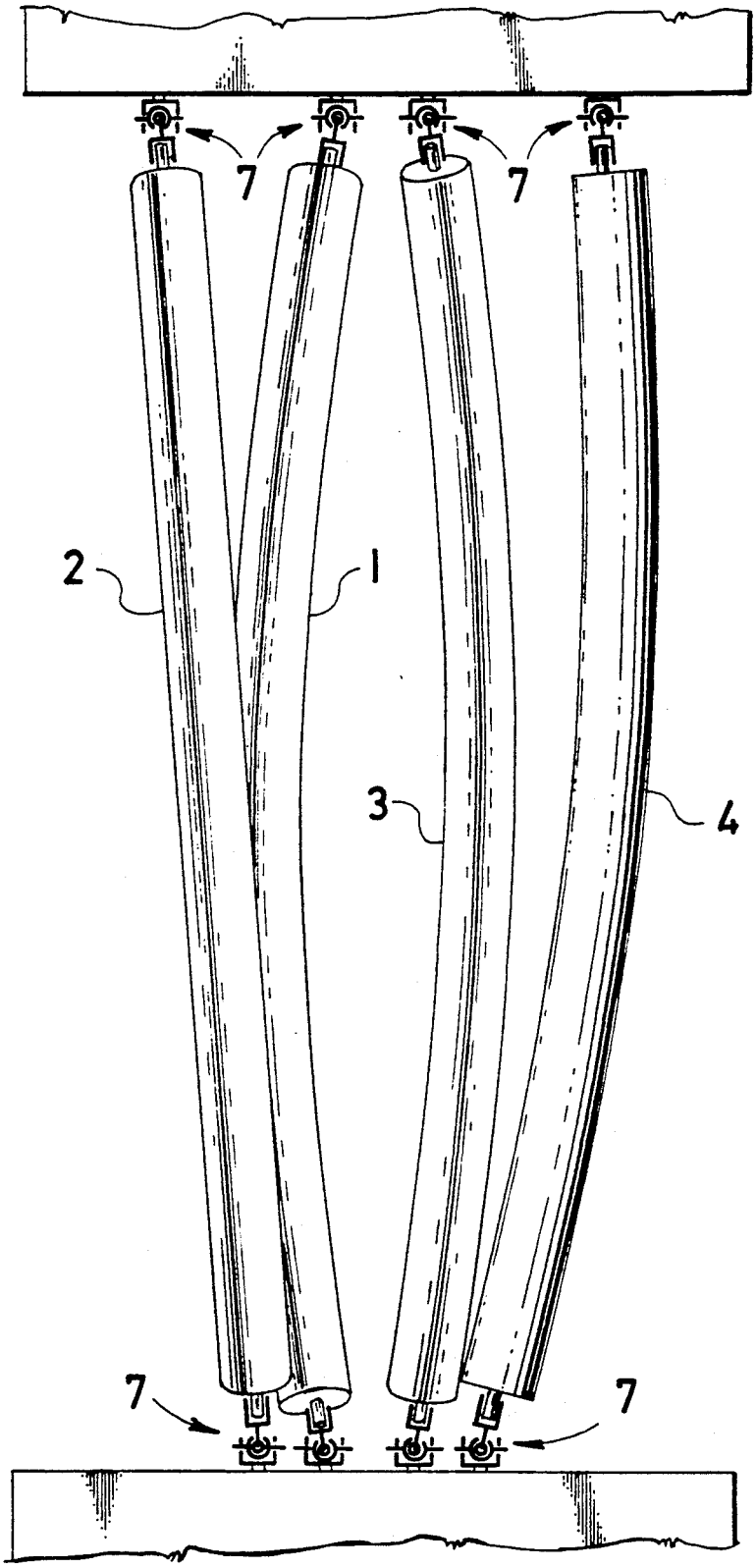
FIG. 6 is a schematic front view of the system of arched cylinders, diagonally tilted to align a skewed weft.
Figure 7:
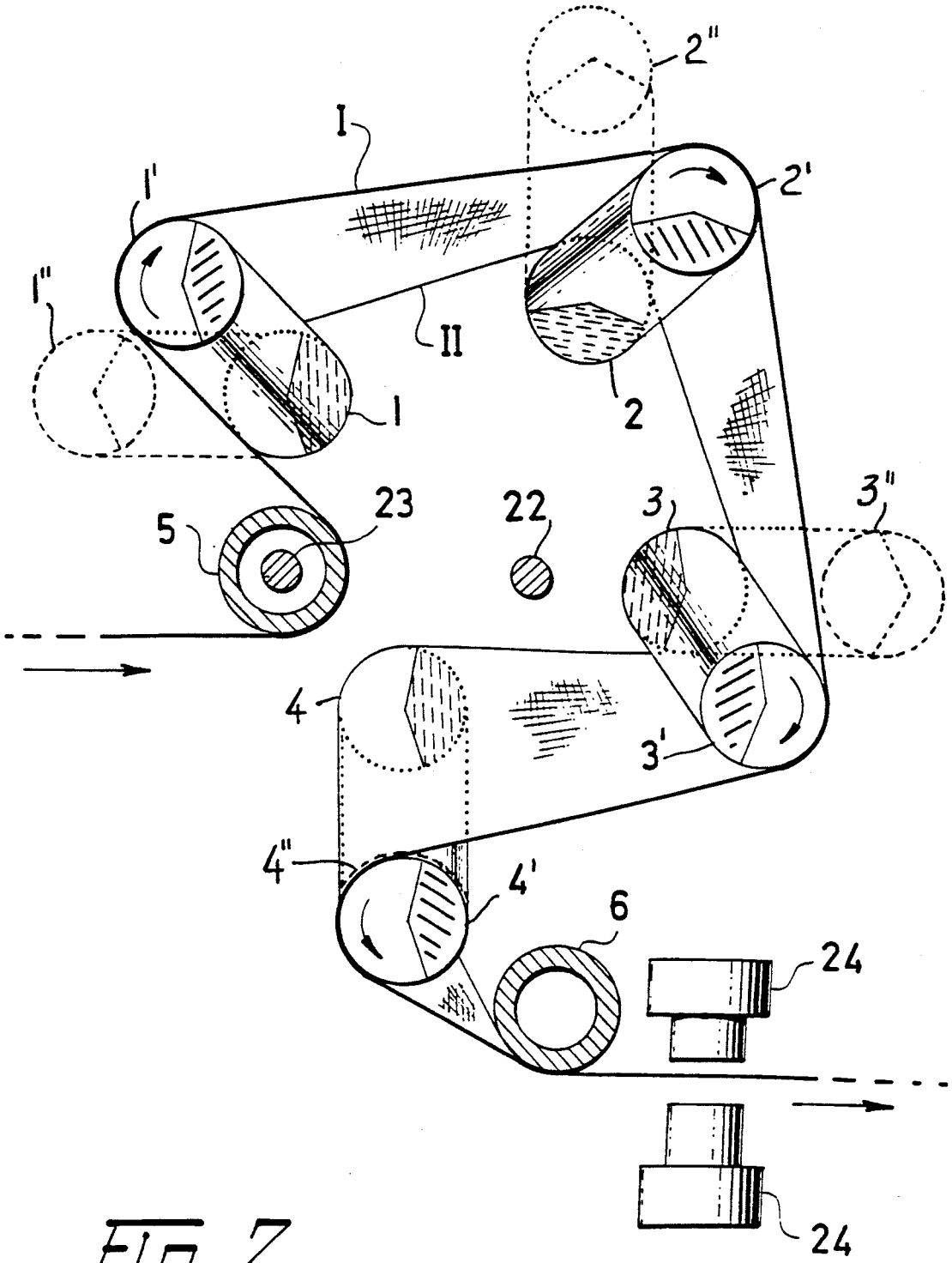
FIG. 7 is a cross section through the center of the system of arched cylinders, diagonally tilted as much as possible to align for a left-side rearward skewed weft and angularly positioned to exert no effect on the weft aligning.

When a textile web with a weft skewed to the left side (considered in the textile web feed direction) (the reference numerals designate a section II thereof) is displaced backwards, the arched cylinders 1, 2, 3, 4 are diagonally tilted to the position shown in FIGS. 6 and 7. The angular position of the aligning cylinders is that shown in FIG. 3. In this position, the path length at the left side of the textile web section II is shorter than that of the right side (shown by the right hand side cylinder cross-section circles 1'', 2'', 4'' and 4''). In the illustrated angular position of the arched cylinders, the path length of the central section I (shown by the circles 1', 2', 3' and 4') of the textile web is equal to the arithmetic mean of the path lengths of the left side and right side of the textile web. Thus, with respect to the central section of the textile web, the left side is displaced forwards and its right side backwards so as to align the weft.

Figure 8:
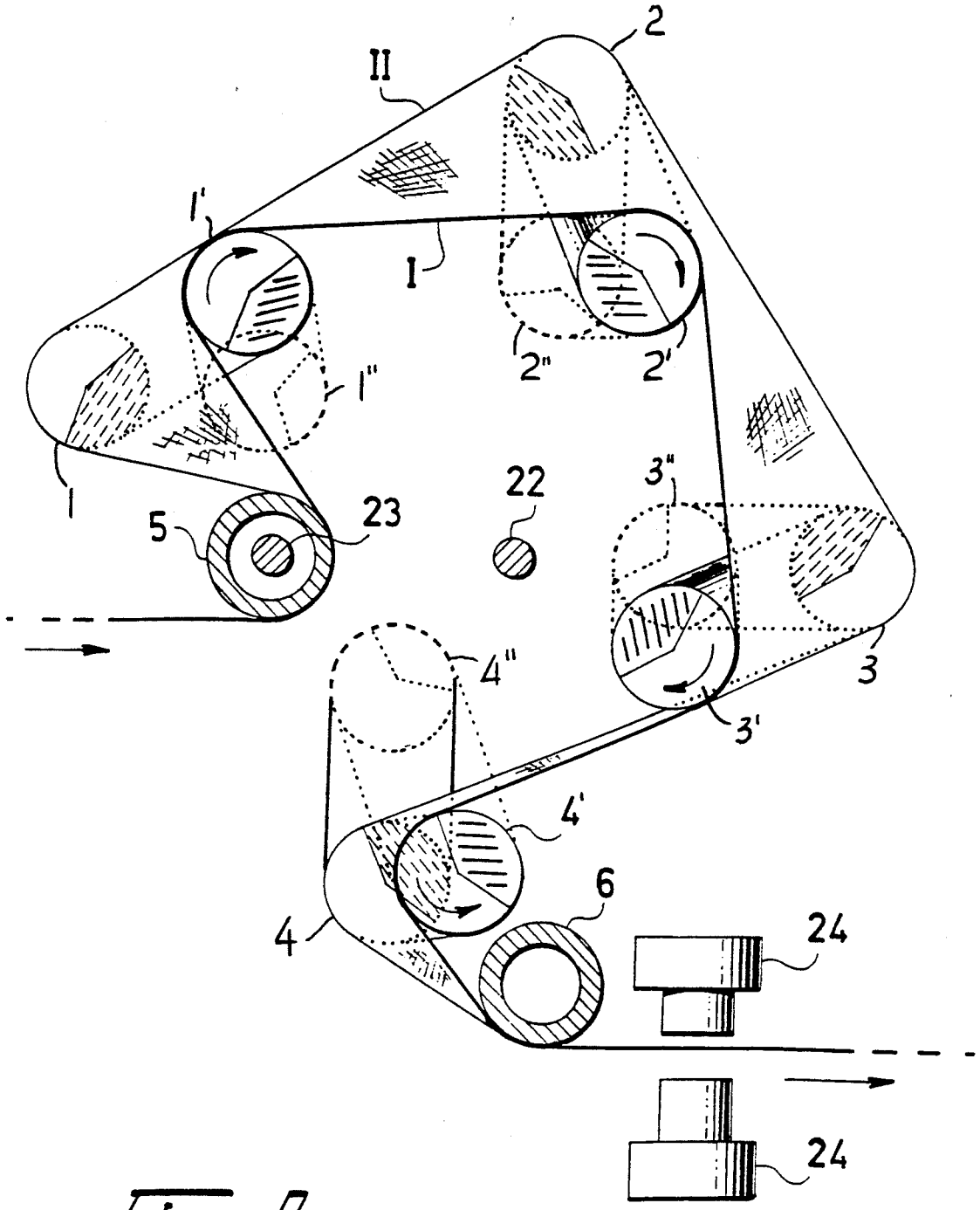
FIG. 8 is a cross section through the center of the system of arched cylinders, diagonally tilted as much as possible to align a right-side rearward skewed weft and angularly positioned as much as possible to align a forward arch.

When a textile web with a skewed weft whose right side is displaced backwards and the weft center is displaced forwards is encountered, the arched cylinders assume the position shown in FIG. 8. The path length differences between the left side (circles 1, 2, 3, 4), the central section (circles 1', 2', 3', 4')--; after "side" insert --(circles 1'', 2'', 3'', 4''), and the right side of the textile web will align the weft. Note that in FIGS. 7 and 8, the circles 1, 2, 3, and 4 designating one end of the cylinders and the position of the circles 1'', 2'', 3'', and 4'' designating the other end thereof reflects the previous discussion of the various mechanisms for moving the cylinders. Thus, for example, see the aforementioned discussion of the mechanism for the diagonal orientation of the cylinders 1, 2, 3, 4 via the servomotor 18, wherein it is specifically mentioned that when the gear boxes 8 which are coupled to ne side of the cylinders move in one direction, for example the left side, the gear boxes 8' move in the opposite direction, etc.

The device permits continuous adjusting of the positions of the arched cylinders 1, 2, 3, 4 so as to compensate for various combinations and degrees of weft deformation, for instance a left side weft skewing combined with a rearward arch, or right side weft skewing combined with a forward arch, etc.

In all these cases, the textile web contacts only those parts of the circumferential surfaces of the arched cylinders that have a widening effect on the textile web.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

I claim:

1. A device for weft alignment of of a moving textile web comprising four aligning arched cylinders, wherein the aligning arched cylinders are so disposed that they define a regular or irregular quadrilateral, and wherein said arched cylinders are further so disposed that said moving textile web maintains contact with said cylinders both when said wefts are being aligned and when no weft alignment is occurring.

2. The device of claim 1, including means for adjustably tilting each of the aligning arched cylinders, each cylinder being tiltable in a respective plane substantially perpendicular to tilting planes associated with adjacent cylinders.

3. The device of claim 2, further including means for rotating the aligning arched cylinders.

4. The device of claim 2, wherein the tilting means comprises displaceable gear boxes, guiding shafts, motion screws, a first servomotor, a second servomotor, worm gears, transmission chains, and cross-pin cardan joints;

each said cylinders having a respective arched axis connected to respective ones of said cross-pin cardan joints, said cross-pin cardan joints being mechanically coupled to said displaceable gear boxes, said displaceable gear boxes being slidable on said guiding shafts and coupled with said motion screws; said guiding shafts being interconnected and connected to be driven by said first servomotor; and said motion screws being interconnected with said second servomotor.

5. The device of claim 1 wherein said arched cylinders are further so disposed that the textile web traversing said cylinders contacts said cylinders on a surface portion thereof that predominantly widens the web in a weft direction.

6. A device for weft alignment moving textile web, said device comprising:

at least three arched cylinders;

first means for adjusting an axial orientation associated with each of the cylinders;

second means for rotating each of the cylinders;

third means for driving and controlling the first and the second means; and said third means being effective to control said first and said second means so that said cylinders are positioned and effective for correcting arch-like skewing or combined arch-like skewing.

7. The device of claim 6, wherein the first means includes a first servomotor and the second means includes a second servomotor, and further including a first through shaft for coupling rotation of said first servomotor from a first to a second side of said cylinders and including a second through shaft for coupling rotation of the second servomotor from the first to the second side of the cylinders.

8. The device of claim 6, further comprising a first guiding cylinder disposed upstream of said arched cylinders and a second guiding cylinder disposed downstream relative to said arched cylinders.

9. The device of claim 8, wherein the second through shaft comprises an axle of the first guiding cylinder.

10. The device of claim 6, further comprising weft position sensors disposed downstream relative to the arched cylinders for detecting the weft position of the moving textile web.

11. The device of claim 6, wherein the device comprises four arched cylinders and the arched cylinders are so disposed that they define a regular or irregular quadrilateral.

12. The device of claim 11, wherein the arched cylinders are so disposed that the moving textile web is able to contact only that part of circumferential surfaces of the cylinders which has a widening effect on fabric of the moving textile web.

* * * * *